United States Patent [19]

Harris

[11] Patent Number: 4,497,290

[45] Date of Patent: Feb. 5, 1985

[54] FUEL SYSTEM TESTER AND PRIMER

[75] Inventor: Robert S. Harris, Connersville, Ind.

[73] Assignee: Stant Inc., Connersville, Ind.

[21] Appl. No.: 483,717

[22] Filed: Apr. 11, 1983

[51] Int. Cl.[3] ..... F02N 9/04

[52] U.S. Cl. ..... 123/179 G; 123/187.5 R; 123/180 P; 137/565

[58] Field of Search ..... 123/26, 187.5 R, 187.5 P, 123/180 P, 518, 179 G, 531, 533; 137/533, 587, 588, 565, 613; 251/148; 141/4

[56] References Cited

U.S. PATENT DOCUMENTS

| | | | |
|---|---|---|---|
| 1,422,998 | 7/1922 | Maltby | 123/26 |
| 1,942,255 | 1/1934 | Parker | 137/565 |
| 2,185,564 | 1/1940 | Parker | 137/565 |
| 2,707,921 | 5/1955 | Jorgensen et al. | 123/187.5 R |
| 2,881,798 | 4/1959 | Oakes | 137/565 |
| 2,985,161 | 5/1961 | Seegrist | 123/187.5 R |
| 3,059,692 | 10/1962 | Smitley | 137/565 |
| 3,371,658 | 3/1968 | Turner | 123/187.5 |
| 3,386,427 | 6/1968 | Powell et al. | 123/463 |
| 4,197,825 | 4/1980 | Altenbach | 123/187.5 R |
| 4,373,479 | 2/1983 | Billingsley et al. | 123/179 G |
| 4,373,502 | 2/1983 | Re | 123/512 |
| 4,375,206 | 3/1983 | Baltz et al. | 123/107.5 R |
| 4,426,978 | 1/1984 | Sasaki et al. | 123/463 |

*Primary Examiner*—Ira S. Lazarus
*Assistant Examiner*—R. S. Bailey
*Attorney, Agent, or Firm*—Barnes & Thornburg

[57] ABSTRACT

A fuel system tester and primer includes a pump for pressurizing a fuel system, a fuel tank adapter, and a conduit for coupling the pump to the adapter. The fuel system tester and primer also includes a pressure release valve for venting excess pressure when a predetermined pressure is reached within the system, and a pressure monitor gauge for detecting pressure changes in a pressurized fuel system.

6 Claims, 2 Drawing Figures

FUEL SYSTEM TESTER AND PRIMER

This invention relates to priming systems. More particularly, the invention is directed to an apparatus for priming fuel systems and detecting leaks in such systems.

It is often necessary to purge a diesel or gasoline fuel injection system of air before an engine will start. This is normally achieved by pressurizing the fuel system with some form of primer.

Primers for fuel systems and radiator systems are known in the art. In some instances, these primers are provided in the fuel or radiator system. Some prime by creating a vacuum and others prime by pressurizing the system. The primers that use pressure have no safety features. These primers rely upon the fuel or radiator system for any safety features.

When priming a fuel system using conventional pressurizing primers, it is difficult to determine when the system has been sufficiently pressurized to force fuel through the system. This can lead to numerous problems. If there is lack of pressure during the priming operation, the system will not in fact prime, leading to repeated priming operations. If there is an excess of pressure applied during the priming operation, the excess pressure can lead to damage to the fuel system if the system has not been designed to withstand excess pressures.

In addition, it is extremely difficult to determine when there is leakage in a fuel system prior to such a leak being one of major proportions.

The present invention solves these problems by providing a priming apparatus that supplies, regulates, and monitors pressure during the priming operation.

Additionally, the apparatus of the present invention can be used to detect leakage from a fuel system in an easy, cost-efficient manner.

In accordance with the invention, a fuel system primer comprises a pump for pressurizing a fuel system, a fuel tank adapter and means for coupling the pump to the adapter. The primer also includes a pressure-release valve for venting excess pressure when a predetermined pressure is reached within the system and pressure-monitoring means for detecting pressure changes in the pressurized fuel system.

Figure 1:
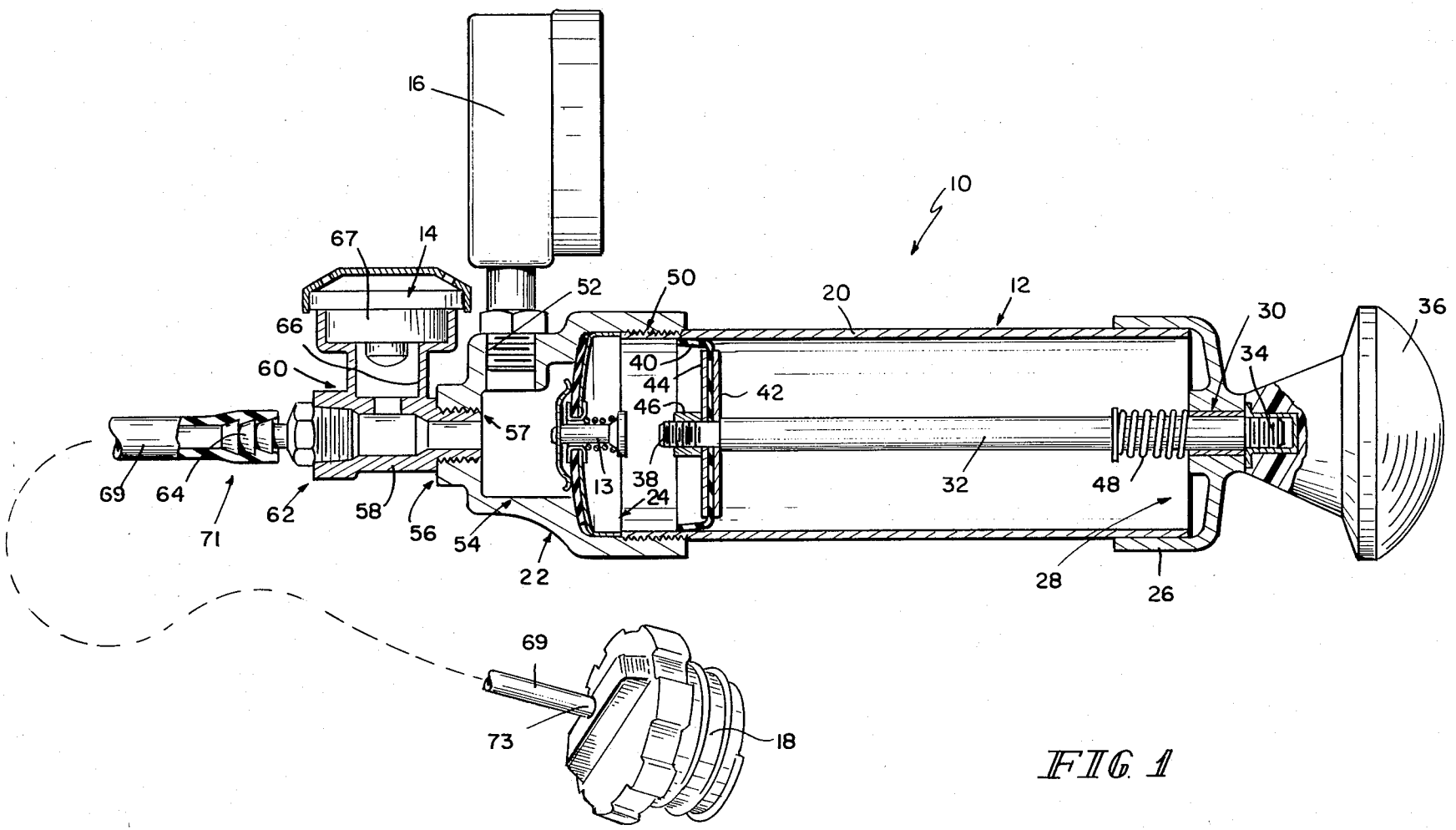
Figure 2:
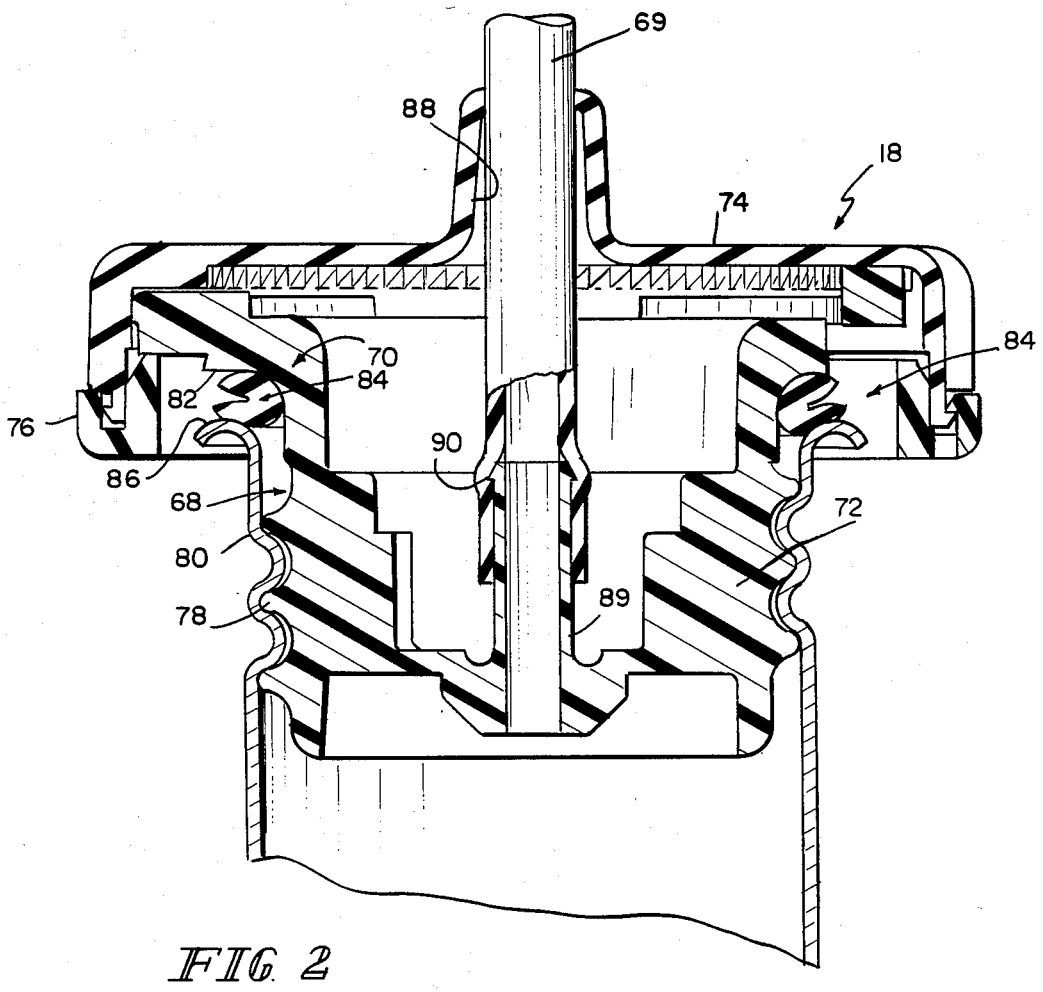

Additional features of the invention will become apparent to those skilled in the art upon consideration of the following detailed description of a preferred embodiment exemplifying the best mode of carrying out the invention. The detailed description particularly refers to the accompanying figures in which:

FIG. 1 is a cross-sectional view of a fuel system primer constructed in accordance with the present invention; and FIG. 2 is a cross-sectional view of the fuel tank adapter shown in FIG. 1, taken generally along the lines 2—2 in FIG. 1.

Referring to the drawings, and particularly to FIG. 1, the fuel system primer 10 includes a reciprocating pump 12, a pressure valve 14, a pressure-monitoring gauge 16, and a pressure tank adapter 18.

The pump 12 comprises a tubular chamber 20 that is threadably engageable with a valve and gauge housing 22 at its axial end 24 and sealably engageable with a rear cap assembly 26 at its distal end 28. The rear cap assembly 26 provides a bushing 30 that slidably receives a pump shaft 32. The shaft 32 is preferably composed of zinc-plated steel. The distal end 34 of shaft 32 is threaded to permit engagement with hand knob 36. Knob 36 is used to facilitate grasping and subsequent manipulation of the shaft 32 in and out of chamber 20. The proximal end 38 of shaft 32 includes a pump seal washer 40 sandwiched between seal plates 42 and 44. The seal washer 40 and plates 42 and 44 are retained on the shaft 32 by nut 46. A spring 48 is positioned on the intermediate portion of shaft 32 to facilitate operation of pump 12. In a preferred embodiment, the seal washer 40 is leather and the plates are zinc-chrome plated steel. The pump 12 also includes a one-way valve 13 seated at the axial end 24 of chamber 20. The valve 13 prevents fluid from entering chamber 20 from the fuel system. It will be appreciated that other pumps may be used without departing from the scope of the present invention. Thus, it is not intended that this invention be limited to any particular pump.

The inner diameter of the proximal portion 50 of valve and gauge housing 22 is threadably engaged with chamber 20 of the pump 12. When the housing 22 and chamber 20 are engaged, the joint is sealed with Permatex Form-a-Gasket or an equivalent sealant.

The intermediate portion 54 of housing 22 includes an aperture 52 configured to threadably engage the pressure-monitoring gauge 16. The joint between aperture 52 and the pressure-monitoring gauge 16 is sealed with Permatex Form-a-Gasket or an equivalent sealant. The pressure-monitoring gauge 16 preferably is a 30 psi pressure gauge.

The distal portion 56 of housing 22 provides a threaded opening 57 that engages a valve adapter 58. The intermediate portion 60 of valve adapter 58 includes the pressure-release valve 14. The proximal portion 62 of valve adapter 58 is threadably engaged to a connector 64. The joint between the connector 64 and valve adapter 58 is sealed with Permatex Form-a-Gasket or an equivalent sealant.

Pressure valve 14 includes a valve passageway 66 and control means 67 that normally closes the passageway 66. The control means 67 opens passageway 66 to release the pressure in response to a predetermined pressure. Various control means 67 may be used. For example, control means 67 may include a control member spring-biased against a seat in the passageway 66 to normally close the passageway 66.

A conduit 69 frictionally engages the connector 64. The proximal end 71 of the conduit 69 is sleeved over ribs on the connector 64. The conduit 69 is preferably a manipulable hose formed of rubber. The distal end 73 of conduit 69 is anchored in tank adapter 18.

Referring to FIG. 2, the tank adapter 18 includes a closure member 68 having an axially outer portion 70 and an axially inner portion 72. The adapter 18 also includes a shell 74 which provides a hand grip. A ring 76 fastens shell 74 and closure 68 together. The axially inner portion 72 of closure 68 is provided with threads 78 to permit threaded engagement with a fuel tank filler neck 80. The radially extending wall 82 of closure 68 retains O-ring gasket 84 adjacent the axially outer portion 70. When adapter 18 is threaded onto neck 80, gasket 84 seats against flange 86 of neck 80, creating a seal between the closure 68 and neck 80.

Shell 74 is provided with an aperture 88 of such size and proportion as to snugly engage the outer surface of conduit 69. The axially inner portion 72 of closure 68 has an inwardly extending connector 89 that is sealably engageable with conduit 69. Connector 89 has a flange 90 to prevent accidental disconnection of the conduit 69 and adapter 18.

In use, tank adapter 18 is threadably engaged with filler neck 80 until gasket 84 is seated against flange 86 of neck 80 to form a snug seal between the adapter 18 and neck 80. A fluid, such as air, is then forced into the fuel system by use of the reciprocating pump 12 until a predetermined pressure is reached. This pressure should be adequate to force fuel throughout the system. Pressure is regulated by pressure valve 14 which is preferably a pressure vent valve. The pressure valve 14 releases excess pressure. The pressure release can be set at any desired pressure setting, dependent upon need.

In using the fuel system primer 10 as a leak detector, the only additional operational steps include pressurizing the system to a predetermined pressure as set by the pressure valve 14, and then visually observing the pressure-monitoring gauge 16 for any decrease in pressure.

The fuel system primer 10 embodying the present invention safely, efficiently, and cheaply supplies, regulates, and monitors pressure during a priming operation. In addition, the fuel system primer 10 provides a quicker, easier, and more efficient manner for detecting possible leaks in a fuel system.

What is claimed is:

1. For use with a vehicle fuel system including a fuel tank having a filler neck provided with fastening elements, a portable hand held apparatus for pressurizing the fuel tank and the system, the apparatus comprising a pump for pressurizing the fuel system, a closure member for coupling the pump to the filler neck, the closure member including fastening elements for removably engaging the fastening elements on the filler neck, a conduit connecting the pump to closure member, pressure relief means for relieving excess pressure within the fuel system, and means for coupling the pressure relief means to the pump.

2. The apparatus of claim 1 further comprising detection means for detecting pressure loss from a pressurized fuel system.

3. The apparatus of claim 2 wherein the detection means comprises a pressure-monitoring gauge.

4. For use with a vehicle fuel system including a fuel tank having a filler neck provided with fastening elements, a portable hand-held apparatus for pressurizing the fuel tank and the system, said apparatus comprising:

a reciprocating pump for pressurizing the fuel tank and the system, a closure member, the closure member including fastening elements for removably engaging the fastening elements on the filler neck, a conduit connecting the pump to the closure member, a pressure valve assembly for relieving excess pressure within the fuel system, and means for connecting the pressure valve assembly to the pump.

5. The apparatus of claim 4 further comprising a pressure-monitoring gauge for detecting pressure loss from a pressurized fuel system and means for connecting the pressure monitoring means to the pump.

6. For use with a vehicle fuel system including a fuel tank having a filler neck provided with fastening elements, a portable hand-held apparatus for testing for leakage in a fuel system, said apparatus comprising a reciprocating pump for pressurizing the fuel system to a predetermined pressure, a closure member, the closure member including fastening elements for removably engaging the fastening elements on the filler neck, a conduit connecting the pump to the closure member, a pressure-monitoring gauge for detecting a pressure change over a period of time, and means for connecting the pressure-monitoring gauge to the pump.

* * * * *